US005543273A

United States Patent [19]

Smith et al.

[11] Patent Number: 5,543,273

[45] Date of Patent: Aug. 6, 1996

[54] RADIATION-SENSITIVE PHOTOGRAPHIC PLATES AND IMPROVED METHOD FOR MANUFACTURE THEREOF

[75] Inventors: Thomas M. Smith, Spencerport; Arlene L. Meyer, Pittsford, both of N.Y.

[73] Assignee: Eastman Kodak Company, Rochester, N.Y.

[21] Appl. No.: 394,115

[22] Filed: Feb. 24, 1995

[51] Int. Cl.[6] ..... G03C 1/74; G03C 1/76; G03C 1/795

[52] U.S. Cl. ..... 430/495.1; 430/496; 430/262; 156/324.4; 156/326; 156/308.8; 428/350

[58] Field of Search ..... 156/317, 336, 156/324.4, 308.8, 326; 428/46, 345, 350, 430; 430/495, 496, 262

[56] References Cited

U.S. PATENT DOCUMENTS

| | | | |
|---|---|---|---|
| 2,387,695 | 10/1945 | Weller | 156/324.4 |
| 2,591,665 | 6/1947 | Ayres | 156/247 |
| 4,033,290 | 7/1977 | Dude | 118/266 |
| 5,254,447 | 10/1993 | Meyer et al. | 430/523 |

FOREIGN PATENT DOCUMENTS

| | | |
|---|---|---|
| 802920 | 1/1974 | Belgium . |
| 55-83042 | 6/1980 | Japan . |

*Primary Examiner*—Mark F. Huff
*Attorney, Agent, or Firm*—Alfred P. Lorenzo

[57] ABSTRACT

Radiation-sensitive photographic plates are prepared by laminating to a rigid transparent plate support a photographic element comprised of a flexible photographic film support having a radiation-sensitive silver halide emulsion layer on one side thereof and a remoistenable adhesive layer on the opposite side thereof. The adhesive layer is non-tacky in the dry state but is reactivated by moistening so as to strongly bond the photographic element to the rigid transparent plate support.

25 Claims, No Drawings

RADIATION-SENSITIVE PHOTOGRAPHIC PLATES AND IMPROVED METHOD FOR MANUFACTURE THEREOF

FIELD OF THE INVENTION

This invention relates in general to photography and in particular to the manufacture of photographic elements which utilize a glass or rigid transparent plastic plate as a support material. More specifically, this invention relates to novel radiation-sensitive photographic plates combining the advantages of high quality and ease of manufacture and to an improved method for their manufacture.

BACKGROUND OF THE INVENTION

Photographic elements are coated on a wide variety of support materials, with the three major categories being plastics, paper and glass. Plastics are used as the support when a combination of transparency, strength, dimensional stability and light weight is needed. Useful plastics include cellulose triacetate, cellulose acetate propionate, cellulose acetate butyrate, polystyrene, polycarbonate and polyethylene terephthalate. Paper is the support of choice in situations where the physical property requirements are not too demanding, cost is a major factor or an opaque base is needed. Typically, photographic paper supports are coated on both sides with a thin layer of a polymeric resin such as polyethylene. Glass has the advantages of excellent dimensional stability and extreme flatness but is disadvantageous in that it is expensive, heavy and brittle. Photographic glass plates typically range in thickness from about 1 to about 10 millimeters and are graded by flatness. Those with the lowest degree of flatness are used in such applications as photomicrography and graphic arts, those with an intermediate degree of flatness in such applications as photofabrication, stereoplotters and aerial cameras, and those with the highest degree of flatness in such applications as high-precision stereoplotters, ballistic and aerotriangulation camera systems and special scientific investigations.

For ease of description, the photographic plates are hereinafter described as "glass plates." It should be understood however that rigid transparent plastic materials can be used as the support in place of glass. Examples of such materials include polymethylmethacrylate and polycarbonate. The use of glass is preferred where excellent dimensional stability is needed but the use of a rigid transparent plastic material such as polymethylmethacrylate or polycarbonate is preferred where machinability is important. Thus, unless the context requires otherwise, the term "glass plates" is used herein in a broad sense to also encompass the rigid transparent plastic materials.

The coating of glass plates with photographic layers is a very demanding art since the layers must be extremely thin, highly uniform in thickness, and completely free from defects. One of the most effective techniques for accomplishing such coating is that described in U.S. Pat. No. 4,033,290, issued Jul. 5, 1977, in which a coating system based on wicking action is employed. In this system, an absorption wick having an arcuate surface is utilized in combination with a transfer wick that is in conforming contact with the arcuate surface. The difficulties involved in coating glass plates are described in this patent as follows:

"The coating of photographic glass plates is a very exacting coating operation in view of the stringent requirements that such plates must be capable of meeting. Thus, for example, to be used successfully for the coating of photographic glass plates the coating process must provide (1) complete coverage of the area which is to be coated, i.e., freedom from "skips" which would result in uncoated areas of even miniscule dimensions, (2) a coating layer which is extremely thin, (3) exactly uniform wet coverage, (4) freedom from coated material on the edges of the plate, (5) freedom from streaks or other coating defects, and (6) freedom from contamination with dust or other foreign materials. In addition the process must be capable of handling fragile sheets of glass without damage."

While the method and apparatus of the aforesaid U.S. Pat. No. 4,033,290 represent an important advance in the art of coating photographic glass plates and have proved highly successful, there are still serious concerns associated with their use. For example, there is a continuing need to still further reduce the number of streaks and other coating defects that occur. It would also be very desirable to be able to coat at much higher speeds than those that are attainable with a wick coater. Moreover, since photographic glass plates are needed in a very wide range of different sizes, there are inherent limitations in any coating operation that make it difficult to meet such needs. Thus, for example, a single coating line is not well suited to coating a very wide range of plates of differing widths, but the provision of multiple coating lines in order to have a separate line for each width desired is economically impractical. Yet another critical problem involved in the manufacture of photographic glass plates is the difficulty in providing edge-to-edge uniformity in the thickness of the silver halide emulsion layer.

As an alternative to coating the functional layers directly on the glass, photographic glass plates have been produced by adhesively securing a conventional radiation-sensitive photographic film to a sheet of glass by means of an adhesive layer interposed between the glass and the film support. The adhesive layer is typically formed by coating a liquid adhesive composition on the surface of the glass plate. The product resulting from such a process comprises a glass support having, in order on one surface thereof, the adhesive layer, the film support material—for example acetate film base or polyester film base—and the silver halide emulsion layer, as well as any other desired functional layers. This method of producing photographic glass plates avoids the problems involved in coating photographic coating compositions on glass. However, photographic film base is typically relatively thick, e.g., in the range of from about 0.1 to about 0.3 millimeters, and may exhibit many minor imperfections and, as a consequence, the optical characteristics of such photographic plates can be seriously degraded if the film base has significant imperfections. Moreover, such a technique still requires coating of an adhesive composition on the glass plate surface with all the difficulties entailed in coating of fragile glass plates. Furthermore, it is exceedingly difficult to prevent excess liquid adhesive composition from coming into contact with the silver halide emulsion layer, whereby it swells the emulsion and seriously damages it.

A wide variety of laminate materials have been proposed for use in the photographic art and these laminates can be employed to protect the emulsion layer of photographic glass plates. Examples of such laminates include those disclosed in U.S. Pat. Nos. 4,077,830, 4,337,107, 4,378,392, 4,581,267 and 5,085,907. However, the photographic glass plates utilized in conjunction with such protective laminates have been made by conventional techniques as described hereinabove.

U.S. Pat. No. 2,591,665 describes a process of laminating photographic film to glass to provide enhanced dimensional stability. In the process described, a glass plate is coated with an adhesive, such as an adhesive of the liquid casein and rubber emulsion type, and united with the photographic film by the use of pressure rollers and the adhesive is then allowed to set so as to bond the film to the glass. This process is disadvantageous in requiring that the adhesive be coated on the glass, in requiring a difficult operating step in which fragile glass plates are passed through pressure rollers, and in requiring a prolonged period to set the adhesive. The '665 patent recognizes the problem of contamination of the silver halide emulsion layer with the liquid adhesive composition and proposes the use of an absorbent protective sheet such as a sheet of paper, to blot up excess adhesive. However, if such an absorbent sheet wrinkles during the lamination process, as is very likely to occur, the wrinkles will damage the silver halide emulsion layer.

Belgian Patent 802,920 describes a process for manufacture of photographic glass plates in which a glass plate support is coated with a wet gelatin layer, a silver halide emulsion layer located on a temporary support film is brought into contact with the wet gelatin layer and the temporary support film is stripped off. Such a process is very difficult to employ on a commercial scale because of the difficulty of providing an emulsion layer that will readily transfer to the coated glass support yet not release during coating, drying, winding and finishing operations involved in its application to the temporary support. The process is also disadvantageous in that it requires that the gelatin which is employed as an adhesive be coated on the glass support and any process in which glass is coated is difficult to utilize commercially because of its fragility.

U.S. Pat. No. 5,254,447 describes several techniques for manufacturing photographic glass plates which are highly advantageous in comparison with the prior technique of coating the functional layers on the glass. Thus, in the '447 patent the silver halide emulsion layer and any other required functional layers, such as antihalation and protective overcoat layers, are applied to the glass plate support by lamination. In a first embodiment of the invention of the '447 patent, a release layer, a protective overcoat layer, a silver halide emulsion layer and an antihalation layer are coated, in order, on a flexible polymeric film and laminated via an adhesive layer to a glass plate having suitable thickness and flatness for use as a photographic support. The release layer is designed to have greater adhesion to the flexible polymeric film than to the protective overcoat layer, whereby the film and release layer can be stripped off prior to the plate being put into use. Depending on the product requirements, the antihalation layer and/or the protective overcoat layer can be omitted. Also, depending on product requirements, there can be two or more silver halide emulsion layers and additional layers providing other functional characteristics can be included. In a second embodiment of the invention of the '447 patent, an element comprising a release sheet, a very thin polymeric film whose thickness is much less than that of the release sheet, and an adhesive layer interposed between the film and the release sheet, is prepared and utilized as a support material on which there is coated, in order, an antihalation layer, a silver halide emulsion layer and a protective overcoat layer. Again, in this form of the process, additional layers can be included and the antihalation layer and/or the protective overcoat layer can be omitted. To prepare a photographic glass plate utilizing this form of the process, the release sheet is stripped away and the remainder of the element is laminated via the adhesive layer to the glass plate.

The manufacturing techniques of the '447 patent employ pressure-sensitive or heat-activatable adhesives and require the use of release layers. This adds substantially to manufacturing costs. Moreover, it is difficult to get such adhesives to fully and uniformly coat the surface to which they are applied and removal of excess adhesive is particularly difficult. Heat-activatable and pressure-sensitive adhesives are prone to trapping particulates which can result in surface irregularities which hurt resolution of the photographic plate. Pressure-sensitive adhesives typically utilize organic solvents which require additional expense and effort for safe handling and for capture of solvent vapors. While the techniques of the '447 patent avoid the difficulties of coating the functional layers directly on the glass plate support and represent an important advance in the art of manufacturing photographic glass plates, further improvement by way of simplifying the elements and steps employed in the process would be highly advantageous in this art.

It is toward the objective of providing a greatly simplified, lower cost and more versatile procedure for manufacturing radiation-sensitive photographic plates, that does not require the coating of any layers on the rigid support, that the present invention is directed.

SUMMARY OF THE INVENTION

In accordance with this invention, a radiation-sensitive photographic plate is comprised of a rigid transparent plate support having in order on one side thereof:

(1) an adhesive layer comprising a remoistenable adhesive;

(2) a flexible photographic film support; and (3) a radiation-sensitive silver halide emulsion layer; the adhesive layer being characterized by having sufficient transparency to permit its incorporation in the radiation-sensitive photographic plate without significant deterioration of the optical properties thereof and sufficient adhesive characteristics to be firmly bonded to the rigid transparent plate support by the steps of moistening, laminating and drying.

The present invention also includes within its scope a novel method for the manufacture of the aforesaid radiation-sensitive photographic plates. Such method comprises the steps of:

(1) providing a rigid transparent plate support;

(2) providing a photographic element comprised of a flexible photographic film support having a radiation-sensitive silver halide emulsion layer on one side thereof and a dry non-tacky adhesive layer Comprising a remoistenable adhesive on the opposite side thereof, the adhesive layer being characterized by having sufficient transparency to permit its incorporation in the radiation-sensitive photographic plate without significant deterioration of the optical properties thereof and sufficient adhesive characteristics to be firmly bonded to the rigid transparent plate support by the steps of moistening, laminating and drying;

(3) moistening the adhesive layer;

(4) bringing the moistened adhesive layer into contact with the rigid transparent plate support so as to laminate the photographic element to the rigid transparent plate support; and (5) drying the adhesive layer.

In the method of this invention, it is not necessary to apply the remoistenable adhesive to the surface of the rigid transparent plate support and, accordingly, the many difficulties involved in coating fragile plates are avoided. The layer of remoistenable adhesive can be applied as one of the steps in the manufacturing of the flexible photographic film support. Since the adhesive layer is non-tacky in the dry state, the flexible film support can be wound and unwound after application of the adhesive layer without encountering blocking problems. As an alternative, the adhesive layer can be applied as one of the steps in the sensitizing operation in which the radiation-sensitive silver halide emulsion layer is applied to the flexible photographic film support. Again, since the adhesive layer is non-tacky in the dry state, the photographic element comprising the radiation-sensitive silver halide emulsion layer on one side of the flexible photographic film support and the adhesive layer on the opposite side can be wound and unwound without encountering blocking problems.

In addition to a remoistenable adhesive, the adhesive layer utilized in this invention can optionally contain other agents such as preservatives, surfactants and thickeners. The essential requirement is that the layer be remoistenable, as contrasted with prior use of pressure-sensitive or heat-activatable layers.

DETAILED DESCRIPTION OF THE INVENTION

The radiation-sensitive photographic plates of this invention utilize as essential components thereof a rigid transparent plate support, an adhesive layer comprised of a remoistenable adhesive, a flexible photographic film support and a radiation-sensitive silver halide emulsion layer. They can also include many other layers including additional silver halide emulsion layers, subbing layers, antihalation layers, and protective overcoat layers. The antihalation layers, silver halide emulsion layers and protective overcoat layers are referred to herein as "photographic layers", or layers formed from photographic coating compositions, since they each have a photographic function in the end product. On the other hand, the remoistenable adhesive layer does not have any photographic function and is present solely to strongly bond the flexible photographic film support to the surface of the rigid transparent plate support.

Typically, the radiation-sensitive photographic plate of this invention will contain other photographic layers in addition to the silver halide emulsion layer. Thus, for example, it can comprise a rigid transparent plate having in order on one side thereof:

(1) an adhesive layer comprising a remoistenable adhesive having the characteristics hereinabove described;

(2) a flexible photographic film support;

(3) an antihalation layer;

(4) a radiation-sensitive silver halide emulsion layer; and (5) a protective overcoat layer.

Since the antihalation layer will typically be positioned beneath the silver halide emulsion layer, there is no need to have an antihalation layer on the opposite side of the plate and such opposite side need have no coatings whatever. This is highly advantageous as it eliminates the many problems that have been previously encountered in having to coat antihalation layers on the back surface of the plate.

As hereinabove described, a key feature of the present invention is the use of a remoistenable adhesive layer. By the term "remoistenable adhesive layer", as used herein, is meant a layer which can be dried to a tack-free state in which it exhibits no adhesive function and can be re-activated by mere application of moisture to form a layer which is capable of strongly bonding to surfaces with which it is brought into contact, such as the rigid transparent plate support utilized in this invention.

The remoistenable adhesive utilized herein is typically a hydrophilic colloid that is liquifiable at room temperature by addition thereto of water or an aqueous medium. Examples of well-known materials that are useful as remoistenable adhesives include dextran, gelatin, vegetable gums, cellulose gums and polyvinyl alcohol.

While the particular material utilized as the remoistenable adhesive in this invention is not critical, it is necessary that the adhesive layer have a sufficent degree of transparency that it will not result in significant deterioration in the optical properties of the radiation-sensitive photographic plate. Adhesive materials not capable of meeting this criterion are not useful in this invention. The adhesive material must also be capable of providing sufficient bond strength as to preclude the delamination of the photographic film element from the plate support in normal use, especially during photographic processing.

A well-known material that has excellent properties when used as a remoistenable adhesive in this invention is "teleostean gelatin." As is well known in the adhesive art, teleostean gelatin is derived from the skins of cold-water fish. Teleostean gelatin is lower in molecular weight and has a different ratio of amino acids than conventional photographic grade gelatin. Fish skin collagen contains lower amounts of the amino acids responsible for the "gelation" normally associated with bovine and porcine derived gelatins. This characteristic allows a dried teleostean gelatin layer to be easily remoistened or "reactivated" to act as an effective adhesive layer. Additionally, teleostean gelatin has a higher concentration of serine, an hydroxy functional amino acid, which provides an improved level of adhesion to many surfaces, including glass.

An example of a commercially available teleostean gelatin which can be advantageously utilized in this invention is HiPure Liquid Gelatin available from NORLAND PRODUCTS, INC. This material has a molecular weight of approximately 60000 and is marketed at a concentration of approximately 45% solids in water. It is desirable to dilute it with distilled water to a concentration of 1 to 5% solids to facilitate coating. At this dilute concentration, a surfactant is helpful as an aid in the coating process. An alcohol ethoxylate (2,6,8-trimethyl-4-nonyloxypolyethyleneoxy-ethanol) available from Union Carbide Corporation under the trademark TERGITOL TMN-10 surfactant, is particularly effective for this purpose and can be advantageously employed at a concentration of about 0.1% based on total solution weight. As supplied, the HiPure Liquid Gelatin has a pH of 5.4 and a gel point of 5°–10° C. It contains 0.20% methyl p-hydroxybenzoate and 0.15% propyl p-hydroxybenzoate as preservatives.

As indicated hereinabove, teleostean gelatin is unique, compared to conventional animal gelatin, in that it does not "gel" at room temperature. Solutions remain liquid at room temperature, but they can be coated and dried to a hard, non-tacky layer which remains water-soluble.

All gelatin is derived from collagen, a long chain protein found mostly in skin and bone. The collagen molecule is made up of twenty different amino acids, with the ratio of these amino acids differing slightly, depending upon the source. End groups on the polypeptide molecule are carboxylic, amino, and hydroxyl. Collagen is insoluble in water, but can be broken down with heat and caustics to produce a water-soluble material. Fish skin collagen breaks down more readily than animal skin collagen. Teleostean gelatin, derived from fish skins, has the same basic chemical constituents as animal gelatin, however, they are present in different proportions. This property reduces the gelation temperature of teleostean gelatin to below room temperature.

Teleostean gelatin, commonly referred to as fish glue, has been used as an adhesive for well over one hundred years. Properties which make it unique include:

1) Aqueous solutions are liquid at room temperature.
2) Completely water-soluble so it can be used as a remoistenable adhesive or a temporary adhesive.
3) Excellent adhesion to a wide variety of substrates.
4) Insoluble in organic solvents.
5) Will not soften at temperatures up to 260° C.
6) It is not gummy and, when dry, it is hard enough to be sanded.
7) It can be made water-resistant and insoluble.

Teleostean gelatin is extracted from the skin of cold water fish, mostly cod. During the manufacturing operation, the skins are thoroughly washed to remove any salt or extraneous matter. They are then cooked in water for a given time and temperature. The resultant broth is drained from the residue and concentrated in an evaporator to increase the 4–6% solids of the liquor to the finished glue solids of approximately 45%. A bactericide is generally added at this point. Properly protected fish glue, stored at room temperature or below, will have a shelf life of at least two years.

Gelatin solutions are amphoteric and will behave as either a weak acid or a weak base. The pH of fish glue ranges from 5.0 to 8.0, depending upon processing conditions. The protein will degrade in time, at a pH below 3.0 or above 9.0.

Like animal-derived gelatin, teleostean gelatin can be rendered water-insoluble by the addition of polyvalent ion salts such as aluminum sulfate, ferric sulfate, or chrome alum. Acid chromates will also insolubilize fish glue, as the chromate will oxidize the glue, and be reduced to trivalent chromium. Some aldehydes are also reported to react with fish glue and insolubilize it.

The inability of teleostean gelatin solutions to "set" like conventional gelatin solutions makes it difficult to coat them utilizing conventional photographic coating apparatus and techniques. However, there are several ways to remedy this problem. For example, addenda can be added to chemically alter the teleostean gelatin molecule to produce gelation at higher temperatures. A second approach is to blend teleostean and animal gelatins to produce an optimum compromise between gelation (coatability) and bond strength (remoistenability). A third approach is to incorporate a thickener to increase the viscosity of a teleostean gelatin solution to a point comparable to a higher molecular weight animal gelatin solution. Examples of suitable addenda include certain hydroxy alkylamine salts of polycarboxylic acids such as triethanolamine citrate (see U.S. Pat. No. 2,899,327) and pyrocarbonic acid esters such as diethyl oxydiformate (see U.S. Pat. No. 2,920,068). By use of water-soluble thickeners, the viscosity of aqueous gelatin solutions can usually be increased with minimal adverse impact on remoistenability. Particularly effective thickeners for this purpose are methyl cellulose and the potassium salt of polyvinyl sulfate.

The remoistenable adhesive utilized in this invention is coated on the photographic film support on the side opposite to the silver halide emulsion layer and dried to a non-tacky transparent layer which can be reactivated with moisture. It can be coated on the film support before or after the coating of the silver halide emulsion layer, and other optional photographic layers, takes place.

The remoistenable adhesive is preferably coated at dry coverages in the range of from about 0.01 to about 2 grams/square meter and more preferably at a dry coverage in the range of from about 0.02 to about 0.1 grams/square meter.

Any of a wide variety of techniques can be employed to remoisten the remoistenable adhesive layer employed in this invention. Thus, for example, a mist of steam or a spray of room temperature water can be applied to the remoistenable adhesive layer. Alternatively a mist of steam or spray of room temperature water can be applied to the surface of the support. As a further alternative technique, the support can be chilled to a low temperature, such as a temperature of 5° C., and then brought into an environment of higher temperature and relative humidity, such as a temperature of 20° C. and relative humidity of 60%. When sufficient condensate has formed on the support surface, the photographic film can be laminated to the support using a rubber-covered roller and slight hand pressure.

In a preferred procedure, the remoistenable adhesive layer is "reactivated" by holding it in a slight stream of tap water at about a 45° angle and temperature of about 35° C. and then immediately (within 15 seconds) laminating the wet layer to a clean dry support using a rubber-covered roller and slight hand pressure. After lamination, the plates are allowed to dry prior to use. Typical drying conditions are a period of at least 24 hours at a temperature of at least 20° C. The preferred relative humidity for use in the drying step is less than 60%.

In the method of this invention, the remoistenable adhesive layer should be moistened with the use of a minimum amount of water. The moistenered layer has to dry while positioned between two nonporous impermeable supports so no more water than is absolutely necessary should be used. The mechanism of drying is believed to rely more on absorption of the reactivation water than on evaporation out the edges of the laminated plate.

Typically, the glass that is used in this invention has a high degree of flatness and a thickness in the range of from about 1 to about 10 millimeters. The invention is particularly advantageous in the production of large format glass plates, for example, those having a major dimension in excess of 75 centimeters. Such plates are used predominantly but not exclusively as shadow masks in the optics and electronic industries. Large format glass plates are especially difficult to manufacture by prior art techniques, because of the great difficulty of handling glass of such dimensions in a coating operation.

The flexible photographic film support utilized in this invention can be any of the polymeric film supports known for use in the photographic arts. Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo- and co-polymers of olefins, such as polyethylene and polypropylene and polyesters of dibasic aromatic carboxylic acids with divalent alcohols.

Polyester films, such as films of poly(ethylene terephthalate) or poly(ethylene naphthalate), have many advantageous properties, such as excellent strength and dimensional stability, which render them especially advantageous for use as supports in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivative thereof. Suitable dihydric alcohols for use in preparing polyesters are well known in the art and include any glycol, wherein the hydroxyl groups are on the terminal carbon atom and that contains from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily.

Specific preferred examples of polyester resins which, in the form of sheeting, can be used in this invention are poly(ethylene terephthalate), poly(cyclohexane 1,4-dimethylene terephthalate), and poly(ethylene naphthalate).

The thickness of the polyester film employed in carrying out this invention is not critical. For example, polyester film of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

A particularly advantageous photographic film support for use in this invention is ESTAR poly(ethylene terephthalate) film manufactured by Eastman Kodak Company.

Polyester films are utilized in photographic elements because their dimensional stability characteristics are unsurpassed. However, because of the difficulty of achieving strong bonding of overlying hydrophilic colloid layers to such films, it is usually necessary to employ a latex subbing layer between a polyester film support and the overlying photographic layer, such as a silver halide emulsion layer or a backing layer. Latex subbing layers used to promote the adhesion of coating compositions to polyester film supports are very well known in the photographic art. Useful compositions for this purpose include interpolymers of vinylidene chloride such as vinylidene chloride/acrylonitrile/acrylic acid terpolymers or vinylidene chloride/methyl acrylate/itaconic acid terpolymers. Such compositions are described in numerous patents such as, for example, U.S. Pat. Nos. 2,627,088, 2,698,235, 2,698,240, 2,943,937, 3,143,421, 3,201,249, 3,272,178, 3,443,950 and 3,501,301. The latex subbing layer is typically overcoated with a second subbing layer comprised of gelatin which is typically referred to in the art as a "gel sub." Functional layers, such as silver halide emulsion layers containing gelatin or other hydrophilic colloid as a binder, are then applied over the gel sub layer.

The gel sub layers that are employed in the photographic art consist of gelatin containing small amounts (<5% by weight) of biocide, surfactant and cross-linking agent. The dry coverage typically ranges from about 5 to about 120 mg/square meter. Such conventional gel sub layers can be used in this invention as an alternative to the use of a teleostean gelatin layer as described hereinabove.

Remoistened gel-subbed ESTAR film can be laminated to the surface of a clean glass plate and, when dry, will resist photographic processing solutions, provide dimensional stability approaching that of glass alone and produce a destructive (ESTAR-tearing) bond between the two adherends.

In practicing the present invention, care must be taken in that certain lubricants that are commonly incorporated in the protective overcoat layer on the photosensitive side of photographic films can transfer to the remoistenable adhesive layer when wound in contact with it. Such transfer can reduce or destroy the ability of the adhesive layer to form a good bond to the support surface. This problem can be overcome by use of an interleaving material which prevents contact between the remoistenable adhesive layer and the lubricant-containing protective overcoat layer. It can also be overcome by eliminating or reducing the concentration of lubricant in the protective overcoat layer or using a lubricant that does not cause the problem. A still further alternative is to moisten the adhesive layer with a dilute aqueous gelatin solution rather than water. Such use of a dilute aqueous gelatin solution masks or compensates for the lubricant-contaminated surface.

Reactivation or moistening of the adhesive layer, whether it be teleostean gelatin or the conventional gel-subbing layer on ESTAR support, allows a significant level of latitude or robustness. Empirical studies reveal that optimal bond strength of the laminate (ESTAR failure) can be obtained as long as the adhesive layer is supplied with sufficient moisture prior to lamination. That moisture can be provided in the form of a mist (steam or atomized water) or a steady stream with no apparent dependency on temperature (within the range of 10°–70° C.). Similarly, there is no apparent dependency upon the source or quality of the water, whether from the tap, distilled, deionized or condensate.

There appears to be a considerable amount of "open-time" associated with these remoistenable adhesive layers. Open-time is defined as the amount of time between re-wetting and the point at which a successful lamination can no longer be produced. It is estimated that the open-time for this process is on the order of several minutes, whereas a time of 30 seconds is ample for use in a production operation.

The photographic plates of this invention can be black-and-white elements, color elements adapted for use in a negative-positive process, or color elements adapted for use in a reversal process. The silver halide emulsion layer can comprise any of the photographically useful silver halides such as silver chloride, silver bromide, silver iodide, silver chlorobromide, silver chloroiodide, silver bromoiodide and silver chlorobromoiodide.

Silver halide emulsions contain a hydrophilic colloid that serves as a binder or vehicle. The hydrophilic colloid is preferably gelatin, but many other suitable hydrophilic colloids are also known to the photographic art and can be used alone or in combination with gelatin. Suitable hydrophilic colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agaragar, arrowroot, albumin, and the like.

The silver halide emulsion layer utilized in this invention typically has a thickness in the range of from about 1.5 to about 4 micrometers and preferably in the range of from about 2 to about 3 micrometers.

As indicated hereinabove, a protective overcoat layer can be included in the photographic plates of this invention. The function of the protective overcoat layer is to provide protection against abrasion, scratching, fingerprints, and the like. The protective overcoat layer is comprised of gelatin or other suitable hydrophilic colloid and typically contains other ingredients such as surfactants and hardening agents. A particularly useful hardening agent is bis(vinylsulfonylmethyl) ether. The protective overcoat layer can also contain a matting agent which can be of either an organic or inorganic type. Examples of organic matting agents are particles, typically in the form of beads, of polymers such as polymeric esters of acrylic and methacrylic acid, e.g., poly(methyl methacrylate), cellulose esters such as cellulose acetate propionate, cellulose ethers, ethyl cellulose, polyvinyl resins such as poly(vinyl acetate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used in photographic elements are further described in U.S. Pat. Nos. 3,411,907 and 3,754,924.

The protective overcoat layer utilized in this invention typically has a thickness in the range of from about 0.2 to about 1 micrometers and preferably in the range of from about 0.4 to about 0.7 micrometers.

In the method of this invention an interleaving material can be used to protect the photographic film before, during and after lamination to the rigid transparent plate support. A thin film of low density polyethylene is useful as an interleaving material.

Antihalation layers are usefully incorporated in the photographic plates of this invention. Such layers contain a dye or pigment dispersed in a suitable binder, such as gelatin, and function to prevent light from being reflected into the silver halide emulsion layer and thereby cause an undesired spreading of the image which is known as halation. In addition to the dye or pigment and binder, they typically also contain a surfactant. Hydrophilic colloids described hereinabove as being useful in the silver halide emulsion layer are also useful as binders in the antihalation layer.

Dyes which are useful in the antihalation layer can be essentially any dye that is useful as a photographic filter dye. These dyes include oxonols, cyanines, merocyanines, arylidenes and the like. The filter dyes may be diffusible or non-diffusible, but are preferably solubilizable during photographic processing for decolorization and/or removal. Water soluble dyes may be used for this purpose. Such dyes are incorporated in the photographic element with a mordant to prevent dye wandering prior to photographic processing. Useful dyes include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897, 3,652,284, and 3,718,472, the enamino hemioxonol dyes of U.S. Pat. No. 3,976,661, as well as ultraviolet absorbers, such as the cyanomethyl sulfone-derived merocyanines of U.S. Pat. No. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 3,215,597 and 4,045,229. Useful mordants are described, for example, in U.S. Pat. Nos.3,282,699, 3,455,693, 3,438,779, and 3,795,519.

In a preferred embodiment of this invention, the filter dyes are solid particle dispersion filter dyes, as described in U.S. Pat. No. 4,092,168 and PCT Publication No. WO88/04794, the disclosures of which are incorporated herein by reference. Such dyes can be described by the formula:

$$[D—(A)_y]—X_n \quad (I)$$

where D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 81 or above. In dyes according to formula (I), X preferably has a pKa of 4 to 11 in a 50/50 volume basis mixture of ethanol and water. The dyes according to formula (I) also preferably have a log partition coefficient (log P) of from 0 to 6 when X is in unionized form.

Solid particle dispersion dyes according to formula (I) offer the advantage of being insoluble and non-diffusible in photographic elements at coating pH's, but soluble for decolorization and/or removal at photographic processing pH's. This is especially advantageous in the photographic elements of the present invention, which have at least one filter dye in an antihalation layer disposed on the same side of the glass plate support as the silver halide emulsion layer. Mordanted soluble dyes in such a layer can be difficult to remove or decolorize during photographic processing, and unmordanted soluble dyes wander to other layers of the element, adversely affecting the sensitometric properties of the emulsion layer(s).

Examples of filter dyes according to formula (I) include the following:

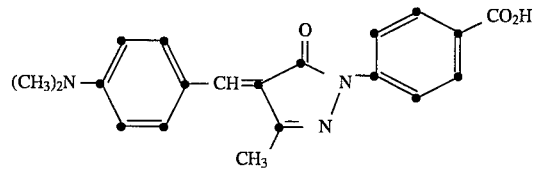

(1)

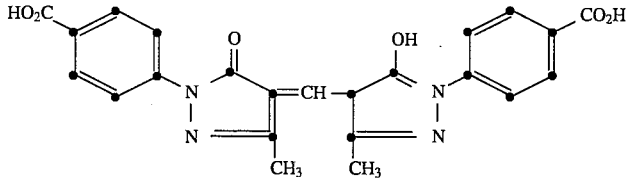

(2)

-continued

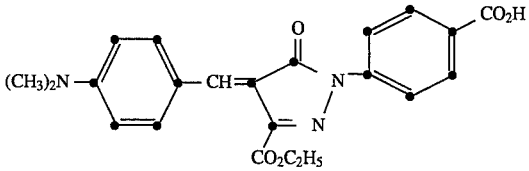

(3)

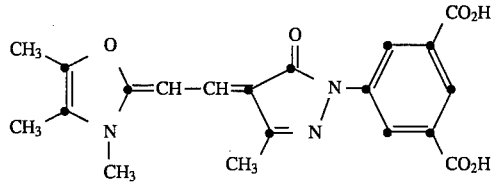

(4)

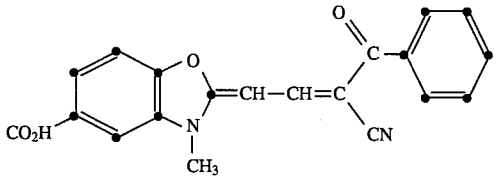

(5)

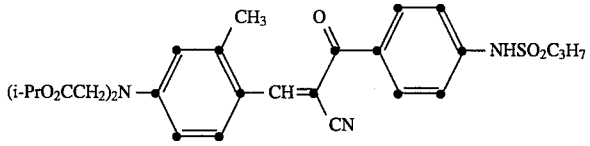

(6)

Other dyes according to formula (I) are described in the above-referenced U.S. Pat. No. 4,092,168 and WO 88/04794. The use of solid particle dyes in antihalation layers or other layers of photographic elements is also described in European Patent Application No. 0391405, published Oct. 10, 1990.

The antihalation layer utilized in the photographic plates of this invention typically has a thickness in the range of from about 0.2 to about 1 micrometers and preferably in the range of from about 0.4 to about 0.7 micrometers.

In the practice of this invention, the element comprising the photographic layers is laminated to the rigid transparent plate using suitable well-known laminating techniques such as the use of deformable pressure rollers. The element containing the photographic layers is typically utilized in roll form so that both laminating and chopping operations, and, in some instances, trimming operations, are required to produce the finished product.

Since the remoistenable adhesive layer utilized in this invention is non-tacky in the dry state, the photographic film element coated with this dry layer can be rolled in contact with the emulsion layer (or other layer such as a protective overcoat layer) on the opposite side of the film support without blocking occurring.

In a preferred embodiment of the present invention, the photographic film is coated with the remoistenable adhesive on the non-sensitized side and chopped to dimensions which are slightly less than those of the rigid plate to which it is to be laminated. In this way, lamination of the photographic film to the plate leaves a border area on the plate which is free of adhesive. This reduces the risk of getting adhesive on the edges of the plate, avoids the need for trimming, and reduces the risk of delamination occurring during finishing operations.

In comparison with the photographic plates of the prior art and the known methods for their manufacture, this invention provides many benefits and advantages. Thus, for example, since the photographic coatings are applied to a flexible support material rather than to a rigid plate, they can be applied by use of the conventional methods and apparatus of the photographic coating art and thus can be coated at much higher speeds, and with far fewer streaks or other coating defects, than can be achieved when photographic coating compositions are coated on a rigid plate. Thus, for example, the photographic coatings can be applied to the support material by such high speed methods as the multilayer bead coating process of U.S. Pat. No. 2,761,791 or the multilayer curtain coating process of U.S. Pat. No. 3,508,497. This advantage more than makes up for the added cost and complexity of utilizing an adhesive layer and a laminating step in the process. Moreover, the laminating process is readily adaptable to use with a wide variety of different sizes of rigid plate material and thus readily accommodates the need for a widely diverse product line. As a further advantage, the risk of damage or breakage to the relatively fragile glass plates is much less in the laminating operation than in a typical coating process.

The present invention eliminates the need to coat directly on rigid plates and the inherent difficulty in achieving uniform layers in carrying out such coating. The remoistenable adhesive layer can be applied during the film manufacturing operation using state-of-the-art techniques and equipment producing a thin, uniform layer that is free of defects. Unlike the heat-curable and pressure-sensitive adhesive layers described in U.S. Pat. No. 5,254,447, the non-tacky remoistenable adhesive layers of this invention are much less likely to entrap dirt prior to lamination and thereby enhance the overall quality of the manufacturing process. The bond achieved with the plate support is permanent and adequately survives plate processing conditions.

Use of a lamination technique as described herein allows incorporation of a border or "safe edge" around the perimeter of the plate. This area can be used for clamping the plate during use without concern over scratching the photosensitive layers and generating dirt. This value-added feature is unavailable with conventional plates.

The lamination procedure utilized in this invention allows the use of a wide variety of existing photographic film products in a wide range of size formats and features, e.g., special surface overcoats, currently unavailable to customers for photographic plates. Dimensional stability of the plate is better than that obtained with pressure-sensitive adhesives and approaches that of conventional direct-coated plates. The manufacturing process can be easily controlled to meet the strict cleanliness requirements of the printed circuit board and shadow mask markets.

The invention is further illustrated by the following example of its practice.

A solution of HiPure Liquid Gelatin, diluted to 4% solids with distilled water and incorporating 0.1% of TERGITOL TMN-10 surfactant, was coated at a wet thickness of approximately eight microns on the non-sensitized side of a black-and-white silver halide photographic film available from Eastman Kodak Company as ACCUMAX AL17, 4901, film. This film has an ESTAR poly(ethylene terephthalate) film support. Coating was done under red safelight conditions using a wire-wound rod applicator. The coating was dried in an oven for approximately ten minutes at 50° C. to give a nominal dry thickness of 0.3 micrometers. The coating was reactivated by contact with tap water at about 35° C. and immediately laminated to a clean dry glass plate support. The laminated plate was dried for 24 hours at 20° C. and 60% RH and subsequently exposed, processed and used in the same manner as conventional photographic glass plates are used. The laminated plate performed satisfactorily in all respects.

In comparison with conventional photographic plates, those manufactured by the techniques described herein have many advantages. For example, they have fewer coating defects since it is much easier to carry out defect-free coating of a flexible support material than to carry out defect-free coating of a rigid plate. They are also more economical to manufacture since a flexible support material can be successfully coated at much higher speeds than a rigid plate. The lamination techniques of this invention also provide a high degree of operational flexibility that facilitates the manufacture of a broad line of photographic plates differing in such features as size, thickness and emulsion type. By use of the method of this invention, it is now feasible to manufacture large format glass plates whose production has previously been impractical The invention has been described in detail with particular reference to preferred embodiments thereof, but it will be understood that variations and modifications can be effected within the spirit and scope of the invention.

We claim:

1. A radiation-sensitive photographic plate; said plate comprising a rigid transparent plate support having in order on one side thereof:

(1) an adhesive layer comprising a remoistenable adhesive;

(2) a flexible photographic film support; and (3) a radiation-sensitive silver halide emulsion layer; said adhesive layer being characterized by having sufficient transparency to permit its incorporation in said radiation-sensitive photographic plate without significant deterioration of the optical properties thereof and sufficient adhesive characteristics to be firmly bonded to said rigid transparent plate support by the steps of moistening, laminating and drying.

2. A radiation-sensitive photographic plate as claimed in claim 1, wherein said remoistenable adhesive is a hydrophilic colloid that is liquifiable at room temperature by addition thereto of water or an aqueous medium.

3. A radiation-sensitive photographic plate as claimed in claim 1, wherein said remoistenable adhesive is gelatin.

4. A radiation-sensitive photographic plate as claimed in claim 1, wherein said remoistenable adhesive is teleostean gelatin.

5. A radiation-sensitive photographic plate as claimed in claim 1, wherein said flexible photographic film support a polyester film.

6. A radiation-sensitive photographic plate as claimed in claim 1, wherein said flexible photographic film support is a poly(ethylene terephthalate) film.

7. A radiation-sensitive photographic plate as claimed in claim 1, wherein said flexible photographic film support is a poly(ethylene naphthalate) film.

8. A radiation-sensitive photographic plate as claimed in claim 1 wherein said adhesive layer comprises teleostean gelatin and a surfactant.

9. A radiation-sensitive photographic plate as claimed in claim 1, wherein said adhesive layer comprises teleostean gelatin and 2,6,8-trimethyl-4-nonyloxypolyethyleneoxyethanol.

10. A radiation-sensitive photographic plate as claimed in claim 1, additionally comprising an antihalation layer and a protective overcoat layer.

11. A radiation-sensitive photographic plate as claimed in claim 1, wherein said rigid transparent plate support is composed of glass.

12. A radiation-sensitive photographic plate as claimed in claim 1, wherein said rigid transparent plate support is composed of plastic.

13. A radiation-sensitive photographic plate as claimed in claim 1, wherein said rigid transparent plate support is composed of polycarbonate or polymethylmethacrylate.

14. A method for the manufacture of a radiation-sensitive photographic plate; said method comprising the steps of:

(1) providing a rigid transparent plate support;

(2) providing a photographic element comprised of a flexible photographic film support having a radiation-sensitive silver halide emulsion layer on one side thereof and a dry non-tacky adhesive layer comprising a remoistenable adhesive on the opposite side thereof, said adhesive layer being characterized by having sufficient transparency to permit its incorporation in said radiation-sensitive photographic plate without significant deterioration of the optical properties thereof and sufficient adhesive characteristics to be firmly bonded to said rigid transparent plate support by the steps of moistening, laminating and drying;

(3) moistening said adhesive layer;

(4) bringing said moistened adhesive layer into contact with said rigid transparent plate support so as to laminate said photographic element to said rigid transparent plate support; and (5) drying said adhesive layer.

15. A method as claimed in claim 14, wherein said remoistenable adhesive is a hydrophilic colloid that is liquifiable at room temperature by addition thereto of water or an aqueous medium.

16. A method as claimed in claim 14, wherein said remoistenable adhesive is gelatin.

17. A method as claimed in claim 14, wherein said remoistenable adhesive is teleostean gelatin.

18. A method as claimed in claim 14, wherein said flexible photographic film support is a polyester film.

19. A method as claimed in claim 14, wherein said rigid transparent plate support is composed of glass, polycarbonate or polymethylmethacrylate.

20. A method as claimed in claim 14, wherein said moistening of said adhesive layer is accomplished with a mist of steam.

21. A method as claimed in claim 14, wherein said moistening of said adhesive layer is accomplished with a spray of room temperature water.

22. A method as claimed in claim 14, wherein said moistening of said adhesive layer is accomplished with a stream of water.

23. A method as claimed in claim 14, wherein said moistening of said adhesive layer is accomplished with condensate from atmospheric moisture.

24. A method as claimed in claim 14, wherein said drying is carried out for a period of at least 24 hours at a temperature of at least 20° C.

25. A method as claimed in claim 14, wherein the dry coverage of said adhesive layer is in the range of from about 0.02 to about 0.1 grams/square meter.

* * * * *